US007450729B2

(12) United States Patent
Nguyen et al.

(10) Patent No.: US 7,450,729 B2
(45) **Date of Patent: *Nov. 11, 2008**

(54) LOW-PROFILE TRANSDUCER

(75) Inventors: An Duc Nguyen, West Hills, CA (US); Charles M. Sprinkle, Ventura, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 550 days.

This patent is subject to a terminal disclaimer.

(21) Appl. No.: 10/821,521

(22) Filed: Apr. 9, 2004

(65) Prior Publication Data

US 2005/0031153 A1 Feb. 10, 2005

Related U.S. Application Data

(60) Provisional application No. 60/461,809, filed on Apr. 9, 2003.

(51) Int. Cl.
*H04R 25/00* (2006.01)

(52) U.S. Cl. ..... 381/152; 381/191; 381/421

(58) Field of Classification Search ..... 381/152, 381/191, 401, 421, 431, 433
See application file for complete search history.

(56) References Cited

U.S. PATENT DOCUMENTS

| | | | | |
|---|---|---|---|---|
| 4,056,697 | A | 11/1977 | Heil | 381/408 |
| 4,276,449 | A | 6/1981 | Sawafuji | |
| 4,385,210 | A | 5/1983 | Marquiss | 381/431 |
| 4,536,623 | A * | 8/1985 | Larson | 381/431 |
| 4,544,805 | A | 10/1985 | Sawafuji | |
| 4,550,228 | A | 10/1985 | Walker | 381/186 |
| 4,903,308 | A | 2/1990 | Paddock | 381/430 |
| 5,283,836 | A | 2/1994 | Trufitt | 381/428 |
| 5,664,024 | A | 9/1997 | Furuta et al. | |
| 5,872,855 | A | 2/1999 | Porrazzo | 381/400 |
| 6,137,891 | A | 10/2000 | Porrazzo | 381/408 |
| 6,285,773 | B1 * | 9/2001 | Carme et al. | 381/431 |
| 6,332,029 | B1 | 12/2001 | Azima et al. | |
| 6,859,544 | B2 * | 2/2005 | Kato et al. | 381/412 |
| 2002/0191808 | A1 | 12/2002 | Croft, III et al | |
| 2004/0037447 | A1 * | 2/2004 | Kam | 381/431 |

FOREIGN PATENT DOCUMENTS

| | | |
|---|---|---|
| FR | 2 765 767 | 1/1999 |
| JP | 59141899 | 8/1984 |
| WO | WO 00/41492 A2 | 7/2000 |
| WO | WO 00/41492 A3 | 7/2000 |
| WO | WO 02/03748 A2 | 1/2002 |
| WO | WO 02/03748 A3 | 1/2002 |

OTHER PUBLICATIONS

Acoustic characteristics of an electrodynamic planar digital loudspeaker[a)], Kenji Furihata et al., *J. Acoust. Soc. Am.*, vol. 114 (1), (Jul. 2003), pp. 174-184.

* cited by examiner

*Primary Examiner*—Suhan Ni
(74) *Attorney, Agent, or Firm*—Pauley Petersen & Erickson

(57) ABSTRACT

One embodiment of a low-profile transducer includes a at least one fin perpendicularly mounted on a planar diaphragm, with a voice coil mounted onto the fin. The voice coil may reside in a strong uniform magnetic field. The locations at which the diaphragm is connected to a frame may be coplanar with a center of mass of the diaphragm. The three-dimensional structure of diaphragm and fins may be formed using origami techniques.

42 Claims, 12 Drawing Sheets

LOW-PROFILE TRANSDUCER

PRIORITY CLAIM

This application claims the benefit of U.S. Provisional Application No. 60/461,809, filed Apr. 9, 2003, the disclosure of which is hereby incorporated by reference herein in its entirety.

RELATED APPLICATIONS

This application is related to U.S. application Ser. No. 10/821,520, filed on Apr. 9, 2004, titled "ACOUSTIC TRANSDUCER WITH MECHANICAL BALANCING", by inventors An Duc Nguyen and Charles M. Sprinkle, and to U.S. application Ser. No. 10/821,520, filed on Apr. 9, 2004, titled "ACOUSTIC TRANSDUCER WITH FOLDED DIAPHRAGM", by inventors An Duc Nguyen and Charles M. Sprinkle, each of which is incorporated by reference herein in its entirety.

BACKGROUND OF THE INVENTION

1. Technical Field

The invention generally relates to transducers. More particularly, the invention relates to an audio transducer capable of reproducing a sound wave and having the benefits of planar and cone-type transducers.

2. Related Art

Various types of transducers are used to reproduce sound. Audio transducers may convert electrical energy into mechanical energy, such as the acoustical output from an audio loudspeaker. Audio transducers also may convert mechanical energy into electrical energy, such as the current output from a microphone. In the voice coil of a loudspeaker's transducer, an electrical audio signal from an amplifier interacts with a magnetic field of a stationary magnet to vibrate a diaphragm. If the vibration frequency is in the audible range, a sound is produced. In general, there are two types of transducers: cone-type (or dome-type) transducers and planar transducers.

Cone-type transducers have a cone usually made from paper, polymer, metal, or a combination of these materials. In a cone-type transducer, a cone is used to excite sound waves in a fluid such as air. The cone may be connected at its outer perimeter to a frame (usually of metal), by a pliable surround—a surrounding support of pliable material. The pliable surround is typically made of foam, rubber, or doped cloth. The inner perimeter of the cone may be connected to a tube structure (usually referred to as a former), which may be wrapped at the end opposite the cone with insulated wire to form a voice coil. Similarly, dome-type transducers use dome-shaped structures (instead of cone-shaped transducers) to excite sound waves. The voice coils of dome-type transducers, however, are typically produced using designs and techniques similar to those used with cone-type transducers.

For cone-type (and dome-type) transducers, the voice coil typically resides in a magnetic gap—a region where the stationary magnet produces a magnetic field. In cone-type transducers, the magnetic gap is generally constructed as a space inside the body of a stationary magnet structure, with the stationary magnets' field oriented orthogonal to the flow of current in the voice coil. The voice coil may be held so that the voice coil does not contact the walls of the stationary magnet.

The magnetic gap in a cone-type transducer is generally configured as a space that separates a magnetic north pole only slightly from a magnetic south pole. Thus, a voice coil placed within this space may be immersed in a relatively strong magnetic field. This relatively strong magnetic field enhances the efficiency of the transducer, better allowing the transducer to convert the power from an electrical signal into the mechanical power of a vibrating diaphragm.

When an electric current is applied through the wire windings of the voice coil in cone-type transducers, the current's interaction with the magnetic field generates a force on the voice coil that is perpendicular both to the magnetic field and to the direction of the current. Depending on the polarity of the electric potential applied to the voice coil, this force may move the voice coil deeper into or further out of the magnetic gap. This in and out movement of the cone causes the cone to vibrate and produce a sound wave.

In other words, when a time-varying electrical current corresponding to a sound wave is driven through a voice coil of a cone-type transducer, the current interacts with the field of the stationary magnet to vibrate the diaphragm. Thus, the diaphragm vibrates in response to the input electric potential. In this manner, the cone-type transducer can reproduce a sound wave that corresponds to the time-varying electrical current.

The distance that the cone moves into and out of the magnetic gap is referred to as excursion. Longer excursion lengths are helpful for providing a lower frequency response for the transducer and a greater acoustic output. Because the voice coil of a cone-type transducer moves in the magnetic gap, the stationary magnet structure subjects the voice coil to a substantially homogenous magnetic field throughout the excursion length. This benefit of a transducer design is described as "magnetic linearity."

Cone-type transducers are typically characterized by a relatively high cone and coil mass, which limits the ability of the cone to vibrate at high frequencies. Some designs reduce the mass of the cone, but may do so at the cost of rigidity of the cone. Cones that are less rigid may suffer from distortion caused when a cone flexes instead of imparting pressure to the adjacent air. Flexing of the cone leads to "break-up"—a failure of the cone to properly reproduce a sound wave. Break-up may occur when the force applied to a cone excites a mechanical flexing mode of the cone instead of a motion that transmits the force into the adjacent air. While there is always some frequency at which a particular transducer cone will break up, a greater ability of the cone to resist flexing generally leads to a wider range over which the transducer may be used without distortion.

Planar transducers are different from cone-type transducers, both magnetically and mechanically. In a planar transducer, a planar diaphragm surface is used to excite sound waves in a fluid. Two common types of planar transducers are electrostatic and planar-magnetic transducers, which use electrical and electromagnetic forces, respectively, to vibrate a diaphragm.

In a planar-magnetic transducer, a diaphragm may be connected at two or more portions of its outer perimeter to a frame. The connection is typically made with an adhesive, but may also be made by fasteners or other mechanical connections. Unlike in a cone-type transducer where a pliable surround connects the diaphragm to the frame, a rigid attachment (usually by adhesive) is generally preferred in a planar transducer. This allows the diaphragm to be held under tension to prevent the diaphragm from sagging and contacting other components during operation.

The diaphragm generally has one or more voice coils integrated onto its planar surface, which are in the same plane as the diaphragm. Multiple stationary magnets are offset to the voice coils, with one or more of their poles generally directed toward the plane of the diaphragm.

The diaphragm of a planar transducer, which serves the same air-movement function as the cone of a cone-type transducer, is generally flat in comparison with the cone of a cone transducer. In a planar transducer, the break-up point of the diaphragm may be determined by the rigidity of the diaphragm material, the tension applied to the diaphragm, and the uniformity of the force applied to the back of the diaphragm. In a cone-type transducer, the break-up point depends on the rigidity of the cone material and the angle of the cone. Thus, with identical material rigidity, the breakup frequency of a cone-type transducer may be determined by cone angle while the breakup frequency for a planar transducer may be determined by diaphragm tension and by how evenly the movement force is applied to the diaphragm.

Both cone-type and conventional planar transducers present users with various disadvantages. For example, even though planar transducers can be significantly thinner than cone-type, planar transducers are unsuitable for many applications where their thinner structure would be a significant benefit. For example, planar transducers may require an impedance-matched transformer to match the impedance of the transducer to the amplifier.

While cone-type transducers may in some cases be more efficient and less complex than planar transducers, they are generally much thicker than planar transducers. Some cone-type transducer designs reduce the depth of the transducer, resulting typically in reduced performance. Some designs use a "cone" that is largely flat, thus reducing the depth of the overall structure. However, as the cone loses its angular orientation between its outer and inner perimeters, it looses structural rigidity. As the angle between the outer and inner perimeters of the cone approaches flat, the rigidity of the cone material must increase markedly. Other designs move the former, voice coil, and magnet to the interior or mouth of the cone. While this reduces the depth of the overall structure, distortion occurs as the sound wave generated by the vibrating cone deflects off the surfaces of the former, magnet, and frame structure.

SUMMARY

This invention provides a design for a low-profile transducer. The low-profile transducer may be used alone or incorporated with a loudspeaker enclosure including additional transducers to produce a broader array of sound waves. The reduced depth of the low-profile transducer may also allow it to be used in many areas, such as on walls and in tight spaces that may be inappropriate for cone-type transducers.

Disclosed herein are techniques for the construction and operation of transducers, including audio transducers that may be used in acoustic loudspeakers. In one example, a transducer includes a frame, a diaphragm attached to the frame, a magnet structure mounted on the frame, at least one fin perpendicularly mounted on the diaphragm, and a voice coil mounted onto the fin. In this example, the voice coil is exposed to a substantially uniform magnetic field created by the magnet structure. The diaphragm has a planar projection surface or at least two arched projection surfaces connected to the fin. The frame may be made of a ferromagnetic material, and configured so that it forms a field-return path in the magnet structure. In addition to, or instead of the fin, one or more side surfaces may be connected at two or more perimeter edges of the projection surface. In one implementation, the diaphragm is a substantially planar diaphragm, and the magnet structure is configured so that a distance between the voice coil and a pole of the magnet structure does not substantially change as the voice coil undergoes driven excursions. In some versions of the low-profile transducer, an audio loudspeaker may be designed to combine the efficiency of a cone-type transducer with the reduced depth of a planar transducer.

In another example, a transducer includes a frame and a diaphragm that has a surface portion and at least one side wall. The surface portion may be cone-shaped, dome-shaped, or flat. The frame is connected to the diaphragm at locations on the side wall, preferably at some distance away from a location where the side wall joins the surface portion. The locations at which the frame is connected to the side wall may be selected to reduce undesired motions of the diaphragm, such as by preventing the excitation of rocking modes. For example, the locations at which the frame is connected to the side wall may be selected to be coplanar with a center of mass of the diaphragm. The side wall may be reinforced with ribs, gussets, or skirts. Reinforcing ribs placed on the side wall (or on a planar projection surface) may be evenly spaced or may be anharmonically spaced. In one implementation, the diaphragm has a planar surface portion, a side wall, and a skirt portion formed from a single sheet of material. A 90° fold in the sheet creates the side wall on the edge of the surface portion. A second 90° fold in the sheet creates the skirt on the edge of the side wall.

In a further example, a transducer includes a single sheet of diaphragm material folded into a substantially flat portion and a fin portion. A voice coil is mounted on the fin portion. The transducer may additionally have side portions, which may be bonded to a frame. The projection surface, fins, and side surfaces may be formed from a single sheet of material, using origami techniques. The sheet may be folded onto itself and bonded with adhesives, such as an epoxy, a resin, or a heat-sensitive, pressure-sensitive, or thermoset adhesive.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Various shortcomings may be found in conventional cone-type and planar transducers. The arrangement of voice coils and magnets in conventional planar transducers is typically different from the arrangement in cone-type transducers. In general, cone-type transducers have voice coils that reside in the magnetic field generated between magnetic poles of a stationary magnet. A stationary magnet may be made purely or partially of a magnetic material. For example, designers commonly use a magnet structure comprising pieces of ferromagnetic material along with one or more magnets. The ferromagnetic material is typically placed in contact with the poles of the magnets, and is shaped to carry magnetic flux from the magnet to end surfaces that then act as magnetic poles. This technique allows designers to concentrate the magnetic field in desired regions. With this design, an electric current passing through the voice coil of a cone-type transducer produces a strong mechanical force due to its interaction with a strong magnetic field.

Figure 1:
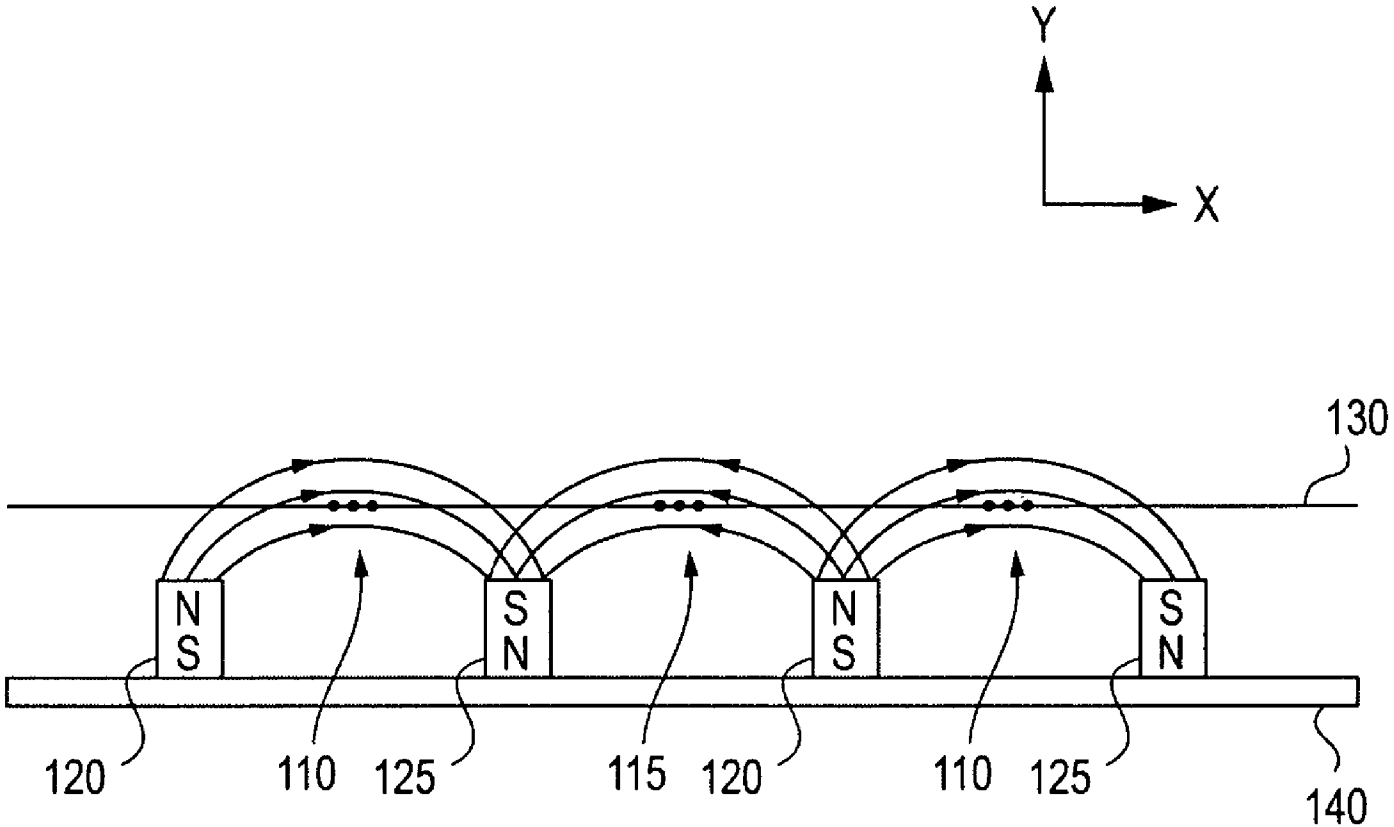
FIG. 1 PRIOR ART
FIG. 1 depicts a cross section of a conventional planar transducer.

The voice coil of a conventional planar transducer resides in a leakage-field region. A leakage-field region may be formed when the voice coil does not reside between two closely-spaced magnetic poles. In a conventional single-sided planar transducer, the voice coil typically resides in flux lines generated by an alternating-pole magnet structure where the magnetic poles are perpendicularly aligned to the diaphragm, as depicted in FIG. 1.

This figure shows a cross section of a conventional planar transducer. The transducer has a flat diaphragm surface 130 onto which voice coils 110 and 115 are bonded. The voice coils reside in fringe magnetic fields produced by magnets 120 and 125. The magnets are affixed to a frame 140. In this figure, the poles of the magnet structure are aligned in a vertical direction (y-axis). The diaphragm and its voice coil reside substantially in a horizontal direction (x-axis) and move in a linear fashion substantially in the vertical direction when energized. Note that in this arrangement, the distance between the magnet structure and the voice coil changes substantially during operation because the diaphragm that contains the voice coil moves either closer to or farther (along the y-axis) from the poles of the magnet structure.

Thus, when an electric potential is applied to the voice coils of a conventional planar transducer, the resultant electromagnetic field from the coil typically interacts with a relatively weak magnetic field (leakage-field) generated at the surface of the diaphragm between adjacent poles of the magnet structure. Because the voice coils must be close to the stationary magnets to interact with their leakage-field, but must not contact the magnet structure while vibrating, the excursion of the diaphragm may be significantly limited.

Additionally, the efficiency of a loudspeaker may be determined by measuring the sound pressure level (SPL) the transducer can achieve at a set power input. Placing the voice coil in a leakage-field reduces the efficiency of planar transducers in comparison to cone-type transducers. In part because of this inefficiency, planar transducers may require multiple voice coils and stationary magnets to apply an even force to the diaphragm and to generate acceptable SPL levels.

In addition to poor efficiency, planar transducers may have reduced magnetic linearity in relation to cone-type transducers. Because the diaphragm travels toward or away from the stationary magnets when the voice coil is energized, the field intensity experienced by the diaphragm and its voice coil varies as the diaphragm moves, as can be envisioned with reference to FIG. 1. Thus, the homogeneity of the magnetic field "seen" by the voice coil changes as the distance between the voice coil and the stationary magnet decreases or increases. This non-linearity may introduce a significant amount of harmonic distortion in the response of the conventional planar transducer, a problem that is generally not a factor with cone-type transducers.

Figure 2:
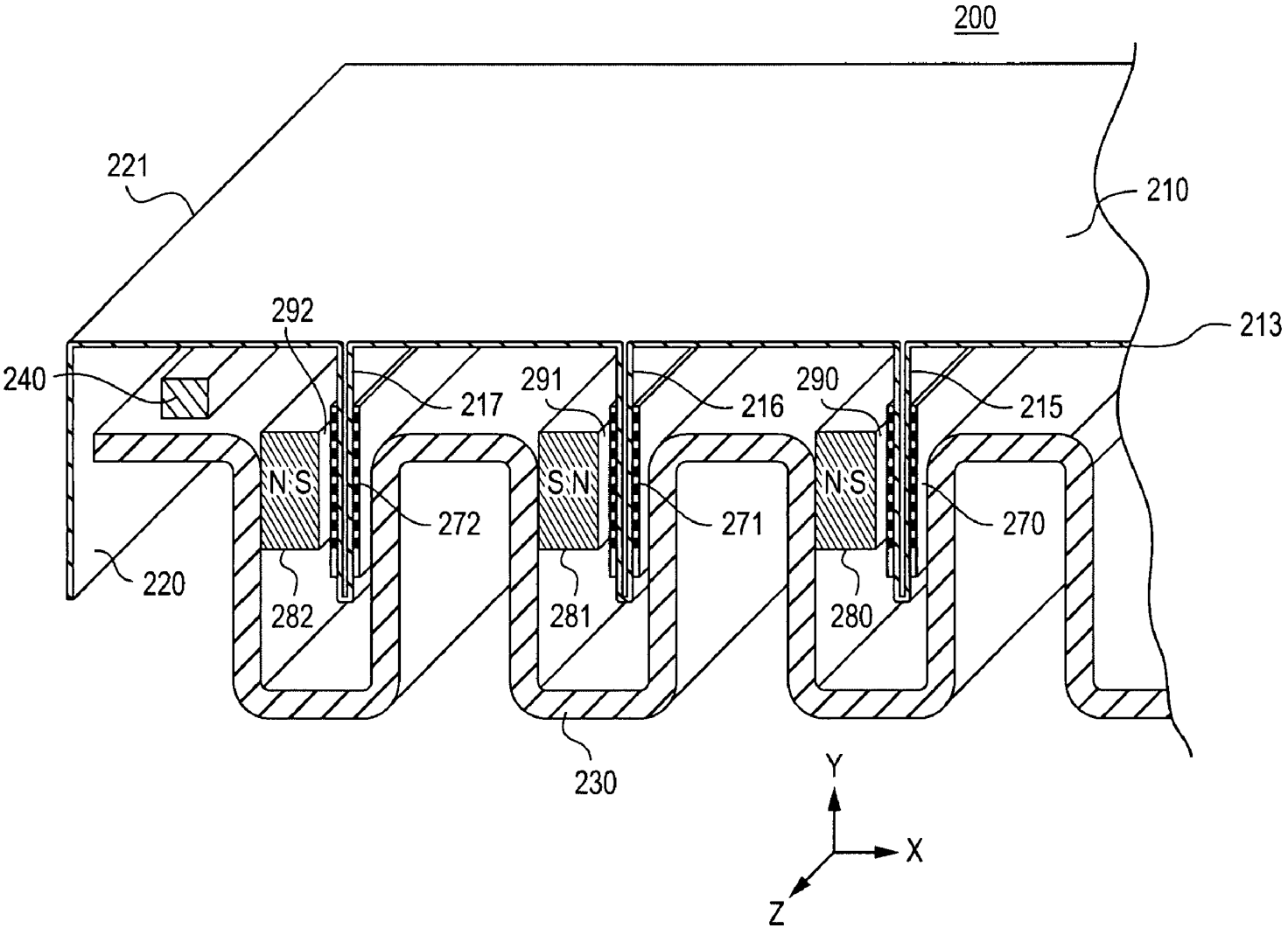
FIG. 2 depicts a perspective view of a first embodiment of a low-profile transducer.

FIG. 2 is a perspective view of a first embodiment of a low-profile transducer 200. The low-profile transducer 200 includes a frame 230; a diaphragm 210 having a perimeter 221, a substantially planar projection surface 213, one or more side surfaces 220, fins 215, 216, and 217 mounted substantially perpendicular to the projection surface 213; stationary magnets 280, 281, and 282, magnetic gaps 290, 291, and 292; voice coils 270, 271, and 272, and a pliable surround 240. The voice coils 270, 271, and 272 are mounted on the fins and reside partially in the magnetic gaps. The low-profile transducer 200 may incorporate these elements in a way that offers the energy efficiency of a cone-type transducer with the reduced depth of a planar transducer. While a particular configuration is shown, the low-profile transducer 200 may have other configurations including those with fewer or additional components.

The frame 230 may be substantially crenellated or corrugated in shape, as shown. The frame 230 may have other shapes. In FIG. 2, the low-profile transducer 200 is shown in relation to a horizontal x-axis, a vertical y-axis, and a z-axis for reference. The stationary magnets 280, 281, 282 are attached to a portion of the frame 230 extending in the z-direction. The stationary magnets 280, 281, 282 may be oriented with alternating polarities to match alternating orientations of current flowing in voice coils 270, 271, and 272. As shown in FIG. 2, the magnets may have an elongated shape extending in the z-direction, with poles aligned in the x-direction. The magnetic gaps 290, 291, 292 may be formed adjacent to poles of the stationary magnets 280, 281, 282.

The poles of the magnets may be positioned in a variety of configurations. For example, the poles of the magnets 280, 281, 282 may be positioned with their poles arrayed in a direction that is substantially parallel to the substantially planar projection surface 213. In addition, or alternatively, the magnets may be oriented so that their fields intersect the voice coils substantially perpendicular to a plane containing the voice coil conductors. Such arrangements are depicted in FIG. 2, and are among the number of contrasts with the conventional designs depicted by way of example in FIG. 1. More generally, a planar transducer may also have magnet structures with magnetic fields that intersect the voice coils at any angle other than perpendicular to the plane containing the voice coil conductors. For example, the angles of intersection between the magnetic field and a fin holding the voice coil conductors may be 20°, 40°, 45°, 60°, 80°, 85°, 88°, 90°, or angles with other values.

The magnets may be attached to the frame 230 by adhesives, screws, brads, rivets, and the like. The diaphragm 210 may be operatively attached to the frame 230 by the pliable surround 240. The frame is preferably made of a ferromagnetic material such as steel, so that it may serve a dual purpose of providing mechanical support to the elements of the transducer, and also provide a return path for the magnetic lines of flux to the magnets 270, 271, 272.

Figure 3:
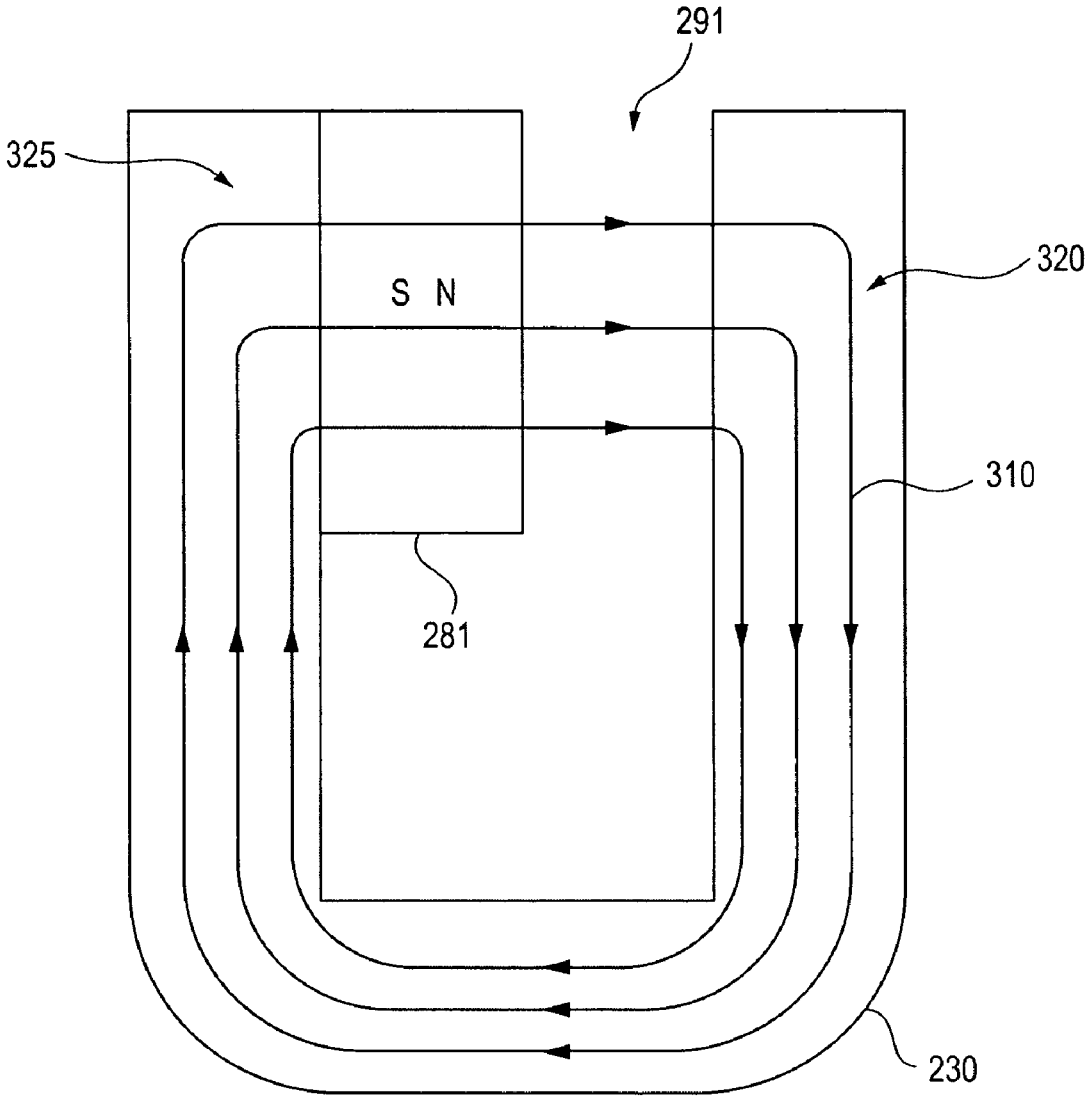
FIG. 3 is an illustrative sketch of magnetic fields in the low-profile transducer from FIG. 2.

FIG. 3 illustrates a return path for a magnetic field formed by the magnet 281 from FIG. 2. This figure depicts a mounting portion 325 of the frame where one pole of the magnet 281 is mounted, and an opposing portion 320 of the frame, which is across the magnetic gap 291 from the magnet 281. The magnetic field lines 310 extend from the poles of the magnets into the planes of the voice-coil windings (shown in FIG. 2). Because the frame 230 comprises a ferromagnetic material, the field lines 310 are guided through the "U"-shaped portion of the crenellated frame. The field lines follow a path from an exposed pole of the magnet 281, through the magnetic gap 291, into the opposing portion 320 of the frame, through the frame structure, back to the mounting portion 325 of the frame, and into the mounted pole of the magnet 281. The lines of flux 310 thus flow in a circuit through a portion of the frame 230.

The frame 230 is preferably designed so that field lines 310 are largely confined in the magnet 281 and the frame 230, except for their transition through the magnetic gap 291. This design may be used to ensure that the magnetic field in the gap 291 is substantially uniform, as depicted in FIG. 3. The design may additionally be used to ensure that the magnetic field generated by magnet 281 is concentrated into the gap 291. With this design, a voice coil residing in the magnetic gap 291 may be exposed to a uniform and strong magnetic field.

This particular arrangement depicted in FIG. 3 contrasts with the conventional arrangement discussed above with reference to FIG. 1. As noted above, in addition to poor efficiency, conventional planar transducers may have reduced magnetic linearity in relation to cone-type transducers. The voice coils in a planar transducer are typically etched or printed on the diaphragm at locations separated from nearby magnets, as shown in FIG. 1. The neighboring windings of voice coils in conventional planar transducers are typically arranged next to each other, arrayed side-by-side along a direction parallel to the magnetic field of the stationary magnets. As may be seen from FIGS. 2 and 3, individual windings in the voice coils of planar transducer 200 are arranged next to each other, arrayed side-by-side along a (vertical) direction perpendicular to the magnetic field in the magnetic gap 291 formed by the stationary magnets. That is, the voice coil windings are arranged in a substantially flat structure for each voice coil, and the voice coil is immersed in the magnetic-field with a plane of the voice coil substantially perpendicular to the magnetic field. Further, the voice coils of planar transducer 200 do not substantially move towards or away from the pole surface of the magnet structure as the voice coils undergo excursions, because the voice coils move in the y-direction, parallel to the pole surface of the magnet structure. That is, a distance between the pole surface and the voice coil is substantially constant during excursions of the voice coil. These features may enhance the strength of interaction between the voice coil and the magnetic field, and provide an enhanced magnetic linearity for the transducer 200.

While multiple stationary magnets and voice coils are shown in the planar transducer 200, a single stationary magnet/voice-coil transducer also may be used. The projection surface 213 of the diaphragm 210 may be any shape extending in the x-z plane of FIG. 2. For example, the projection surface 213 of the diaphragm 210 may be a rectangle, which includes a square, or an oval, which includes a circle. The diaphragm 210 also may have fins. For example, the diaphragm 210 may have two fins connected on two opposing sides, and a third fin between the opposing sides.

When the fins and the projection surface of the transducer 200 are formed from a single sheet of material, the sheet may be folded to create the fins and the projection surface. The side surfaces 220 may similarly be created by folding the sheet of material. The sheet may be folded so one 90° fold is adjacent to another 90° fold, such as shown for example, for side surface 220 and fin 217. Similarly, the sheet may also be folded so two 90° folds are adjacent to a 180° fold, as shown for fins 215, 216, 217. When the diaphragm has two or more fins formed from a single sheet of material, the sheet may be folded so a 90° fold is adjacent to a second 90° fold and the second 90° fold is adjacent to a 180° fold, as shown for example by fins 215 and 216.

The diaphragm 220 may be composed of a single, integral material. Or, one, some or all of the perimeter 221, the substantially planar projection surface 213, the one or more sides 220, and the fins 215, 216, and 217 may be composed of different materials. FIG. 2 shows fins 215, 216, and 217 may be used in combination with the substantially planar projection surface 213. Any type of projection, protuberance, or extension from the substantially planar projection surface 213 may be used for mounting voice coils. Alternatively, voice coils may themselves be attached at one edge or at one surface directly onto the projection surface 213, with a primary portion of the voice coil extending at an angle away from the projection surface 213.

Moreover, as shown in FIG. 2, the fins 215, 216, and 217 are substantially perpendicular to the substantially planar projection surface 213. Specifically, the fins 215, 216, and 217 form a 90° angle with the substantially planar projection surface 213. Alternatively, the fins may form any angle greater than 0° and less than 180° with the substantially planar projection surface 213. For example, the fins may form angles of 20°, 40°, 45°, 60°, 80°, 85°, 88°, 90°, or angles with other values, with the substantially planar projection surface 213. In this manner, the fins are not in the same plane as the substantially planar projection surface 213.

Further, as shown in FIG. 2, the voice coils 270, 271, and 272 are not in the same plane as the substantially planar projection surface 213. Similar to the fins, the voice coils 270, 271, and 272 are substantially perpendicular to the substantially planar projection surface 213. Specifically, the voice coils 270, 271, and 272 form a 90° angle with the substantially planar projection surface 213. Alternatively, the voice coils may form any angle greater than 0° and less than 180° with the substantially planar projection surface 213. In this manner, the voice coils are not in the same plane as the substantially planar projection surface 213.

Figure 4:
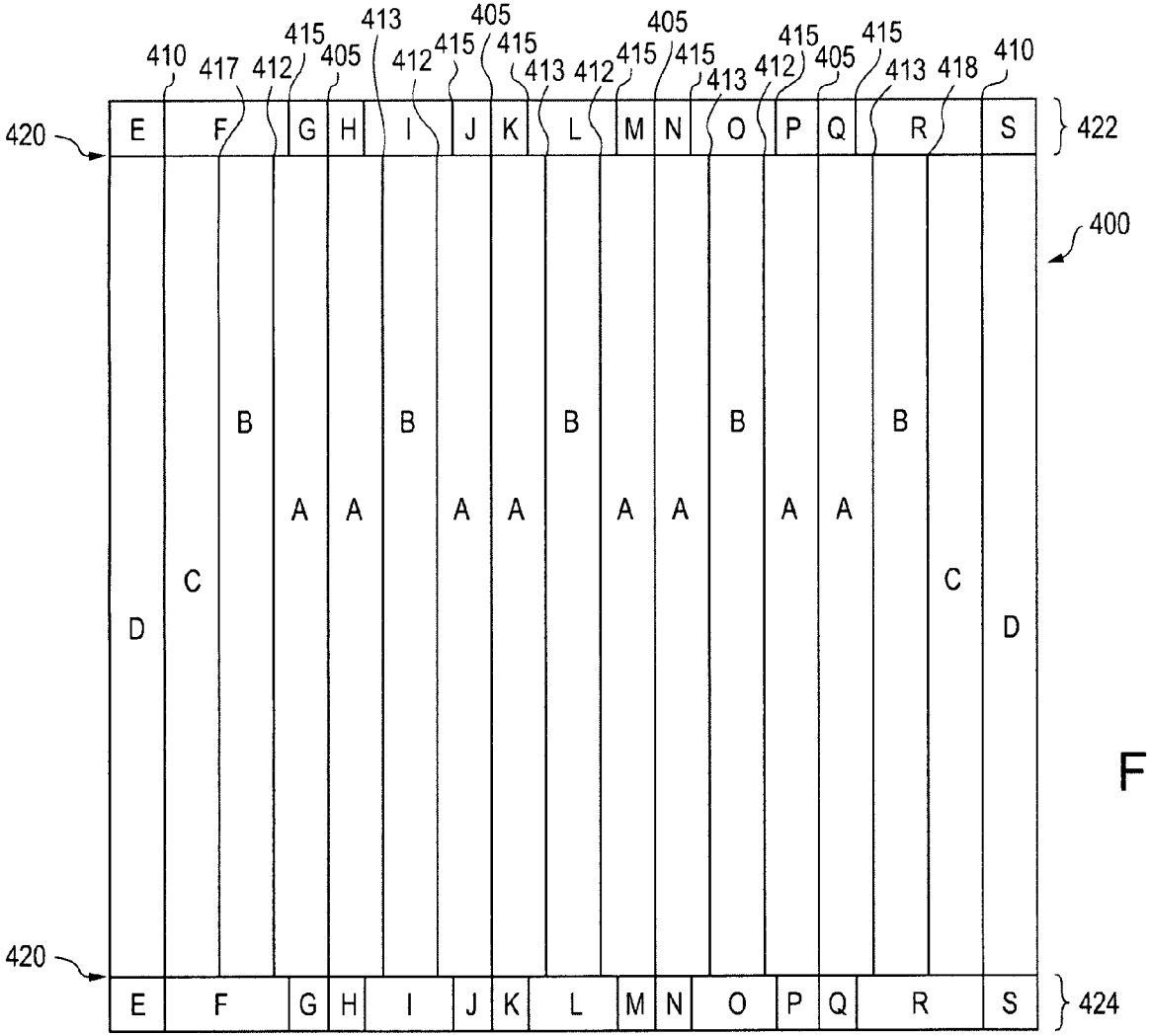
FIG. 4 shows an example of a sheet of material that may be folded to create a diaphragm for a low-profile transducer.
Figure 5:
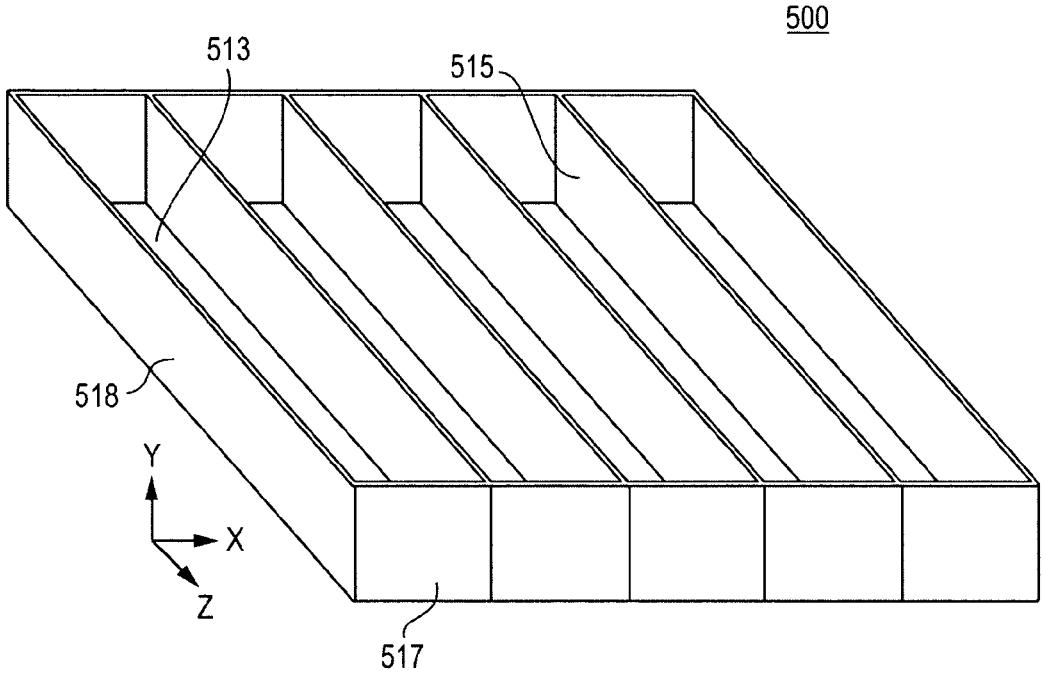
FIG. 5 depicts a bottom perspective view of a diaphragm for a low-profile transducer.

FIGS. 4 and 5 depict one approach to forming a diaphragm of a low-profile transducer. FIG. 4 shows an example of a sheet of material that may be folded to create a diaphragm, fins and side surfaces. The folding procedure resembles origami-style procedures for generating a three-dimensional structure from a flat sheet. In this case, the folding is designed to provide a diaphragm whose final shape is depicted in FIG. 5. A sheet 400 may have dimensions of approximately 20 cm ×20 cm. Other sizes dimensions may also be used, according to the desired dimensions of the diaphragm. The drawing in FIG. 4 shows a front surface of the sheet 400. A back surface of the sheet is not shown. The front surface is marked for illustration with lines indicating regions A-S of the sheet and lines along which folds and cuts are made to form the structure of a diaphragm 500 depicted in FIG. 5.

FIG. 5 shows a bottom-perspective view of a diaphragm 500 for a planar transducer. The diaphragm 500 has an interconnected perimeter and fins that extend perpendicularly away from a planar acoustic surface. The diaphragm 500 has a flat acoustic projection surface 513, four fins 515, two side surfaces 518, and two end surfaces 517. The side surfaces and end surfaces provide a degree of mechanical rigidity to the diaphragm 500. In alternative embodiments of the diaphragm, more or fewer fins may be used, and one or more side and end surfaces may be eliminated or replaced with alternative bracing structures, such as cross-braces, for example.

In the example shown in FIG. 4, the sheet 400 may be folded so that regions A form fins 515 of the diaphragm 500, while regions B form the projection surface 513, regions C and D form the side surfaces 518, and regions 422 and 424 form the end surfaces 517. Cuts are made in regions 422 and 424 along lines 405, 410, and 415. These cuts reach from edges of the sheet 400 to lines 420. To form fins 515, 180° folds are made along lines 405 so that the back of each region A meets the back of a neighboring region A. The folded regions A form fins 515 shown in FIG. 5. Folds of 90° are then made along lines 412 and 413 so that regions B form the projection surface 513 shown in FIG. 5. (Note that the 90° folds along lines 412 are made in a mirror-image direction relative to the 90° folds along lines 413.) The sheet is then folded 90° along lines 417 and 418, and 180° along lines 410 so that the backs of regions D meet the backs of adjacent regions C, forming side surfaces 518. (Note that the 90° fold along lines 417 is made in mirror-image direction relative to the 90° fold along line 418.)

The preceding cuts and folds create the fins 515, the side surfaces 518, and the projection surface 513 of the diaphragm 500, with flaps G, H, J, K, M, N, P, and Q extending from the fins 515. Similarly, flaps F, I, L, O, and R extend from the regions B of the projection surface, and flaps E, F, R, and S extend from side surfaces 518. These tabs are each folded 90° along lines 420 to interweave together and form end surfaces 517 of the diaphragm 500. The tabs may be fastened together using adhesives or heat treatment, such a thermoset bonding, or other bonding techniques.

Figure 6:
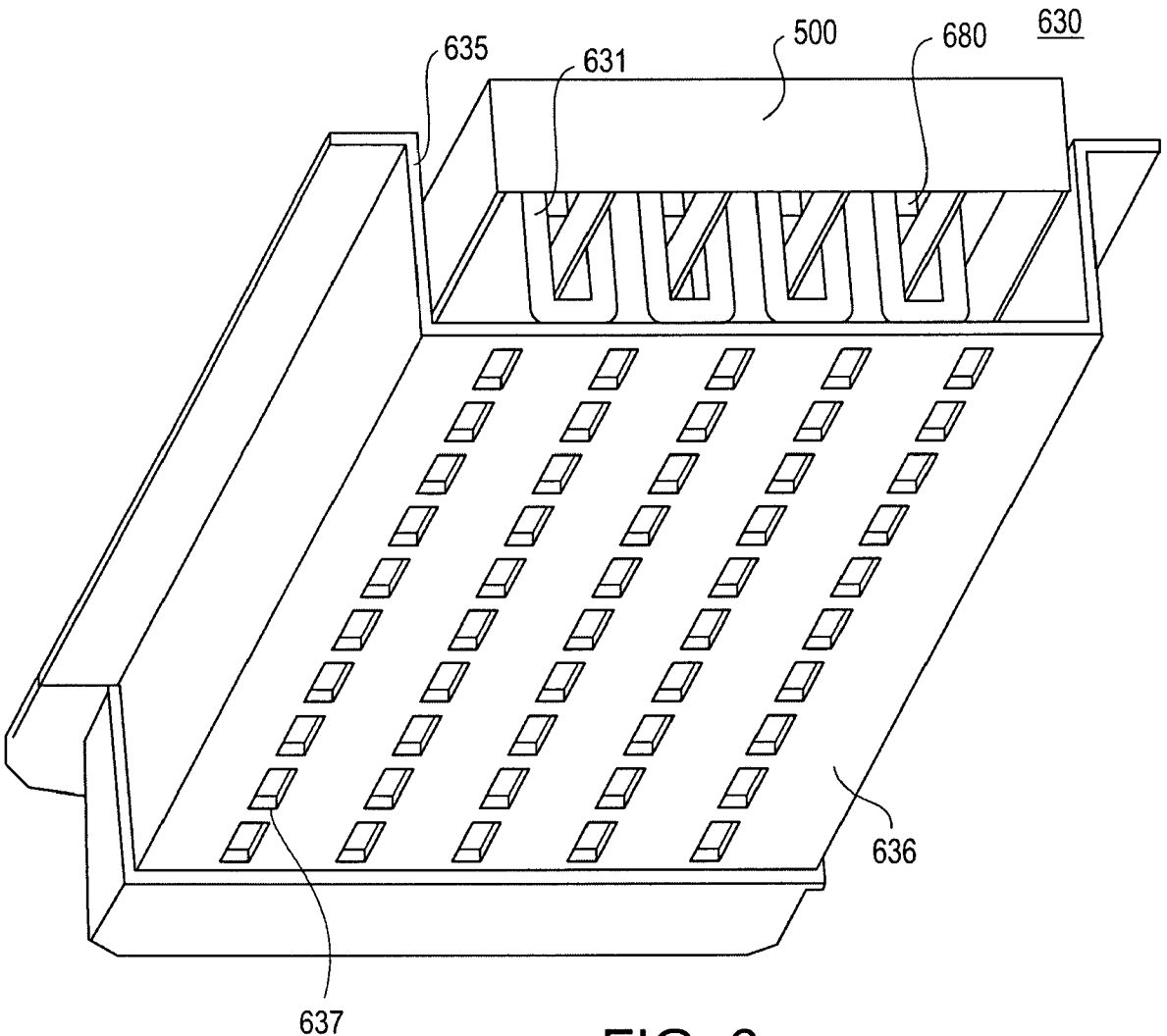
FIG. 6 shows one embodiment of an assembly for a planar transducer.

FIG. 6 shows one embodiment of an assembly 630 for a planar transducer. The assembly 630 includes the diaphragm 500 from FIG. 5, magnets 680, one or more field-return yokes 631, and a mount 636. The mount may include side portions 635 and breather holes 637.

Magnets 680 are mounted on the yokes 631. The yokes 631 may be formed as part of a frame, such as frame 230 from FIG. 2. Fins of the diaphragm 500 extend into magnetic gaps formed by the magnets 680 and the yokes 631. The yokes are affixed to the mount 636. The diaphragm may be connected to the side portions 635 of the mount 636 by a pliable surround (not shown).

Figure 7:
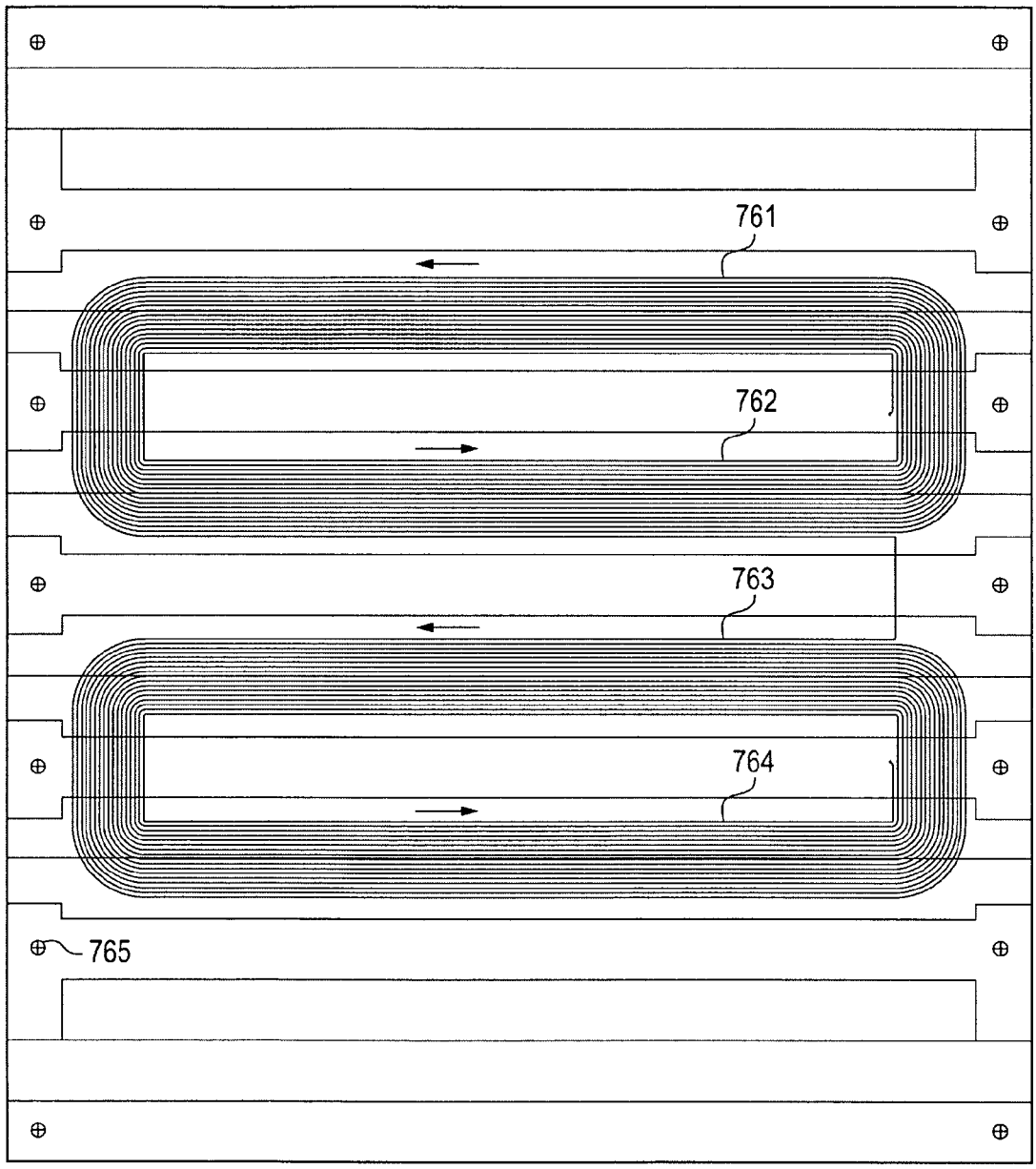
FIG. 7 shows one embodiment of a conductor pattern for a voice coil circuit.

FIG. 7 shows one embodiment of a conductor pattern for a voice coil circuit. The pattern illustrates the layout for four voice coils 761, 762, 763, and 764. This conductor pattern may be affixed to the sheet of material 400 depicted in FIG. 4, prior to the folding of the sheet 400. With appropriate alignment, voice coils 761, 762, 763, and 764 may be folded into position on the fins 518 shown in FIG. 5.

The folding of the diaphragm and voice coil may be automated using a folding machine adapted for folding the diaphragm. Alignment registers 765 may be printed on the sheet 400 to facilitate alignment of photomasks or other tools for forming the voice coils onto the diaphragm sheet. The directions of current flows may alternate between adjacent coils, as indicated by the arrows in FIG. 7.

Many variations are envisioned for examples of planar transducers. For example, the diaphragm 210 may be operatively attached to the frame 230 by the pliable surround 240. The pliable surround may connect the frame 230 to the projection surface 213 or to one or more fins 215, 216, and 217. One or more pliable surrounds may be used. The fins 215, 216, and 217 may be attached to the diaphragm 210. Other variations are also envisioned. The perimeter side surface may be attached by an adhesive or by a pliable surround to the frame. Alternatively, the projection surface may be attached by its edges directly to the frame by an adhesive or by a pliable surround. Regarding the frame 230, a ferromagnetic material such as steel may be used to provide mechanical strength and a return path for the magnetic field. Alternatively, a non-ferromagnetic material may be used, preferably in conjunction with added ferromagnetic structures to provide return paths for the magnetic fields.

Figure 8:
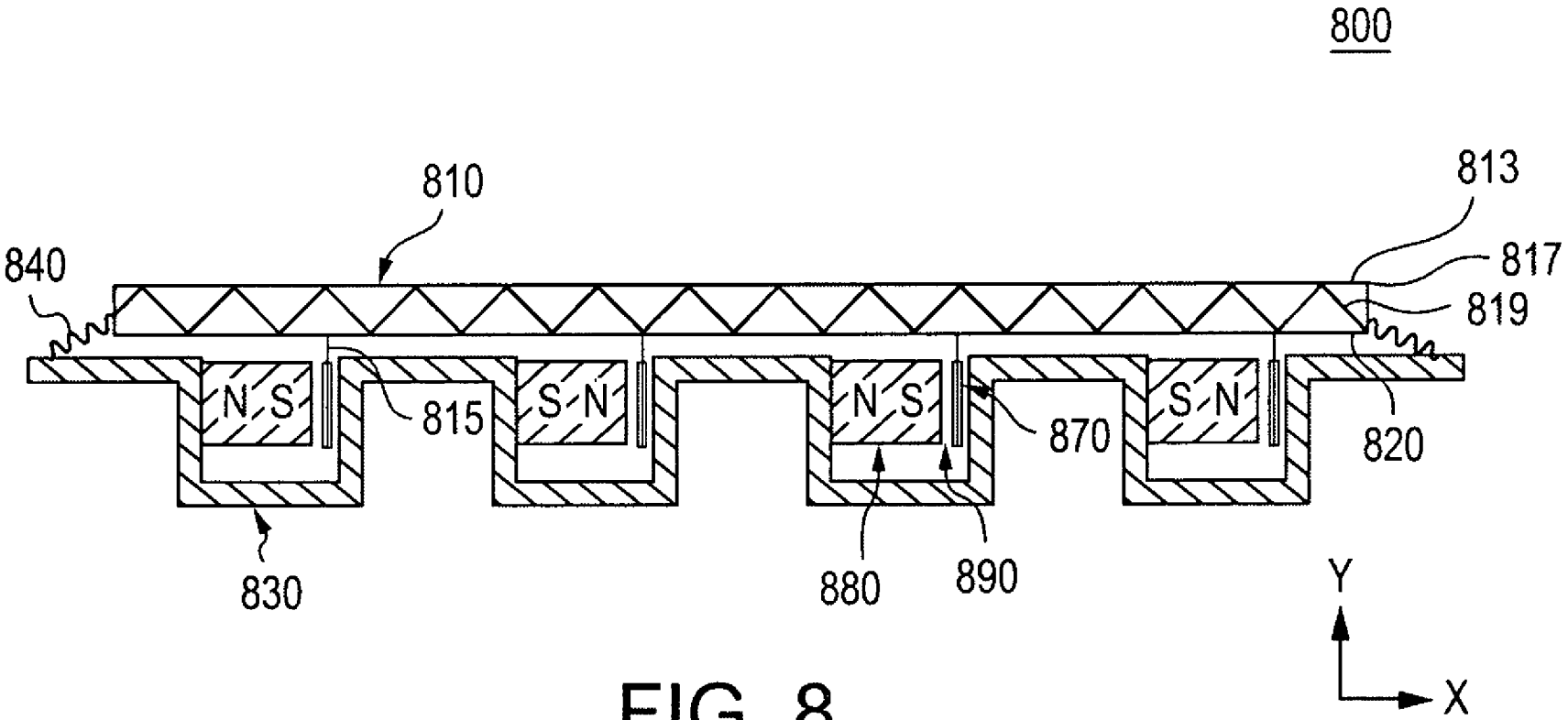
FIG. 8 depicts a cross section of a second embodiment of a low-profile transducer.

FIG. 8 is a cross-sectional view of a second embodiment of a low-profile transducer 800. The low-profile transducer 800 includes a crenellated ferromagnetic frame 830, a rigid diaphragm 810 having a substantially planar projection surface 813, stationary magnets 880, magnetic gaps 890; voice coils 870; and a pliable surround 840. The diaphragm 810 is made of a substantially rigid material, with voice coils 870 mounted onto the diaphragm and extending away from the diaphragm. The voice coils 870 are preferably mounted in a direction extending perpendicularly away from the surface of the diaphragm 810, and reside partially in the magnetic gaps 890 formed by the magnets 880 and the frame 830. The stationary magnets 880 are attached to a portion of the frame 830 extending in the z-direction, with poles aligned in the x-direction, parallel to the plane of the substantially planar projection surface 813. The magnetic gaps 890 may be formed adjacent to poles of the stationary magnets 880. The magnets may be attached to the frame 830 as shown, and the diaphragm 810 may be operatively attached to the frame 830 by the pliable surround 840.

The rigid diaphragm 810 may be made from a variety of techniques. For example a rigid diaphragm may be made from a solid piece of flat material or from a laminated foam material. Alternatively, a rigid diaphragm may be made from two substantially parallel sheets of a polymer joined with ribbings of the same or a different material to form an internally corrugated or honeycomb-type structure. For example, diaphragm 810 from FIG. 8 may be made by gluing a tightly folded interior sheet 819 to a bottom sheet 820 and then gluing a top sheet 817 to the folded sheet 819.

Figure 9:
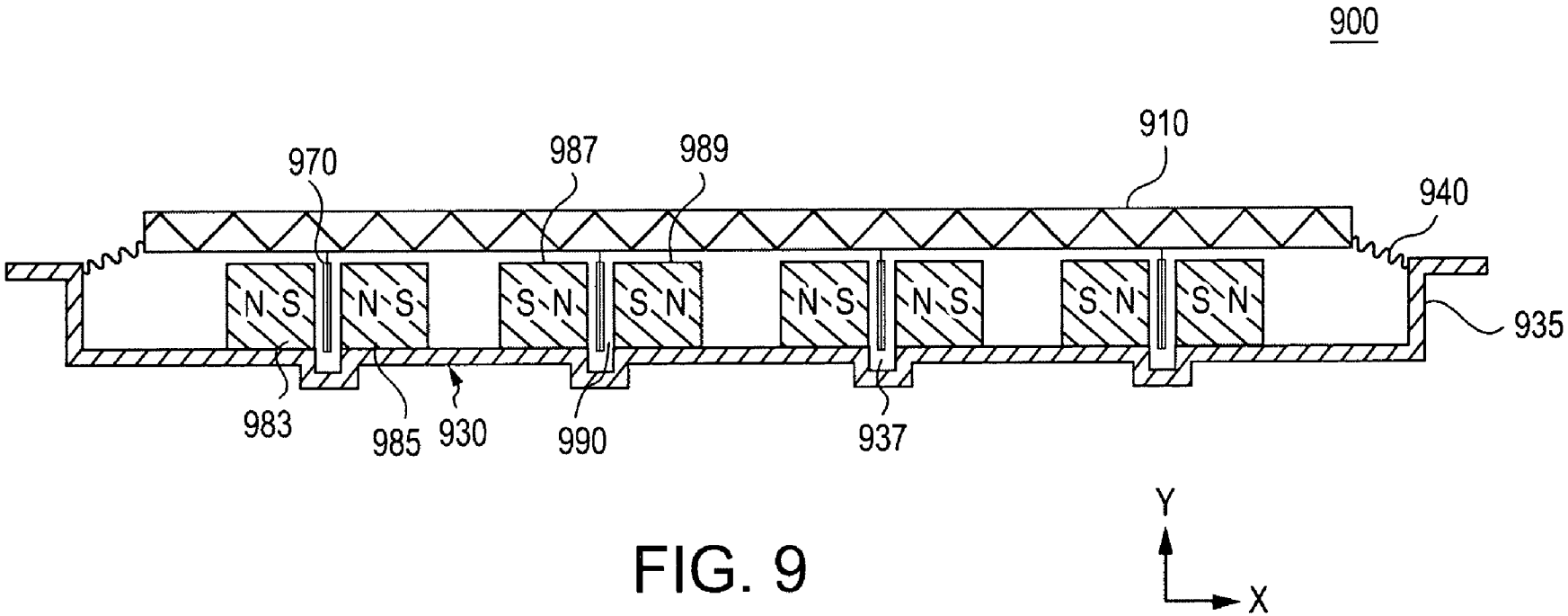
FIG. 9 depicts a depicts a cross section of a third embodiment of a low-profile transducer.

FIG. 9 is a cross-sectional view of a third embodiment of a low-profile transducer 900. The low-profile transducer 900 includes a crenellated non-ferromagnetic frame 930, a rigid diaphragm 910, stationary magnets 983, 985, 987, and 989, magnetic gaps 990, voice coils 970, and a pliable surround 940.

The bottom of the frame may have one or more grooves 937 and sides 935. The diaphragm 910 may be made of a substantially rigid material, with voice coils 970 mounted onto the diaphragm and extending away from the diaphragm. The diaphragm may be operatively attached to sides 935 of the frame by the pliable surround 940.

The low-profile transducer shown in FIG. 9 uses grooves 937 as a technique for extending a range of motion of the voice coils 970. Grooves 937 may be used in a variety of embodiments of a low-profile transducer to accommodate the excursion of the voice coils.

At least two stationary magnets 987 and 989 are used to form the magnetic gaps 990 between closely-spaced opposing magnetic poles. The poles of the stationary magnets 987 and 989 may be parallel, but with opposite polarity. Stationary magnets 987 and 989 may be in contact with a bottom of the frame. The poles of stationary magnets 987 and 989 are depicted as oriented along the x-axis. A neighboring pair of magnets 983 and 985 may also be oriented along the x-axis, with an opposite polarity to the stationary magnets 987 and 989.

It is noted that that the gaps 990 formed in this manner do not take advantage of a closed return path for the magnetic field, since the frame 930 is not ferromagnetic, and no other return path is provided for the magnetic field in this embodiment of the transducer 900. Thus, this embodiment makes a comparatively inefficient use of magnets, in comparison with embodiments using ferromagnetic materials to guide the magnetic fields, such as discussed above.

Figure 10:
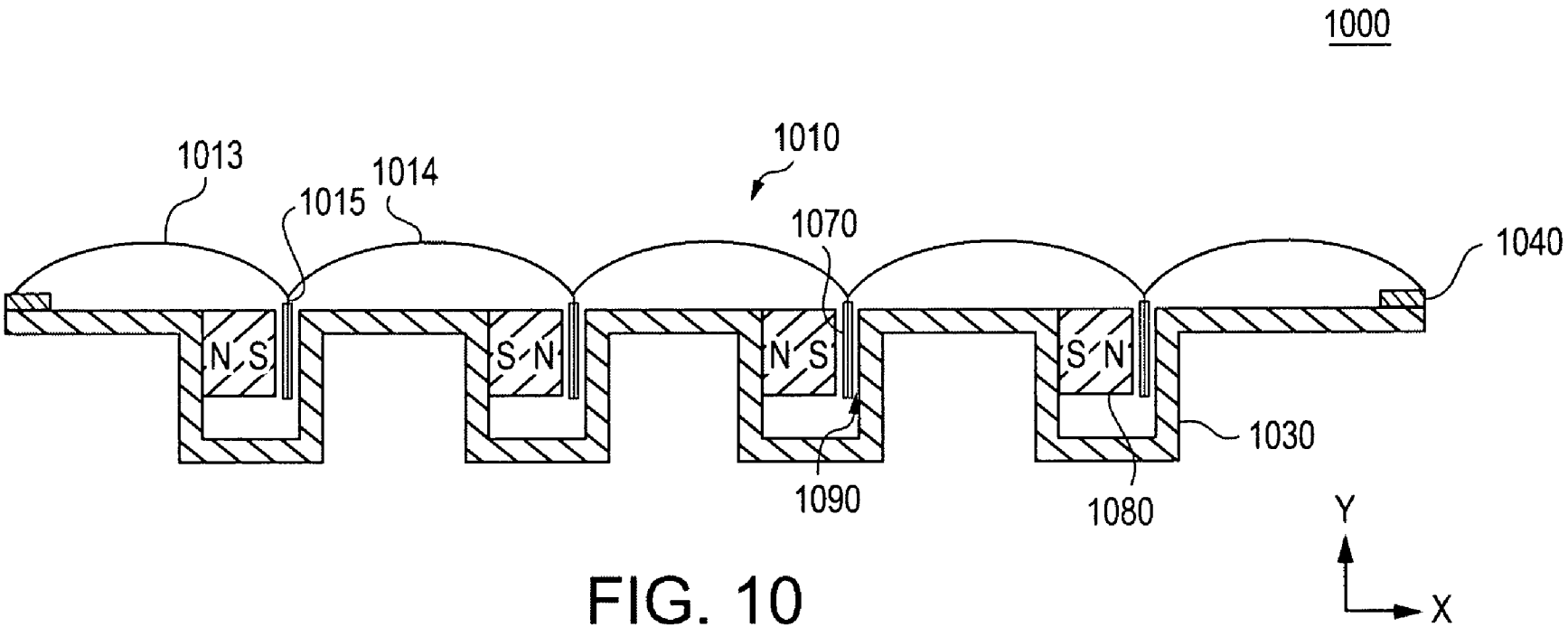
FIG. 10 depicts a cross section of a fourth embodiment of a low-profile transducer.

FIG. 10 is a cross-sectional view of a fourth embodiment of a low-profile transducer 1000. The low-profile transducer 1000 includes a crenellated ferromagnetic frame 1030, a diaphragm 1010 having at least two arched projection surfaces 1013 and 1014, joined to least one substantially flat fin 1015, stationary magnets 1080, magnetic gaps 1090, voice coils 1070, and a pliable surround 1040. The fins 1015 are mounted onto the diaphragm, extending away from the diaphragm. The fins 1015 are preferably mounted in a direction extending perpendicularly away from the diaphragm 1010, as shown.

The arched projection surfaces 1013 and 1014 may be configured to impart a degree of rigidity to the diaphragm. In low-profile transducer 1000, two projection surfaces of the diaphragm are joined to each fin. At least two projection surfaces of the diaphragm are operatively attached to the frame, such as by pliable surround 1040.

The voice coils 1070 are mounted onto the fins 1015, and reside partially in the magnetic gaps 1090 formed by the magnets 1080 and the frame 1030. The stationary magnets 1080 are attached to a portion of the frame 1030 extending in the z-direction, with poles aligned in the x-direction. The magnetic gaps 1090 may be formed adjacent to poles of the stationary magnets 1080. The magnets may be attached to the frame 1030 as shown, and the diaphragm 1010 may be operatively attached to the frame 1030 by the pliable surround 1040.

Figure 11:
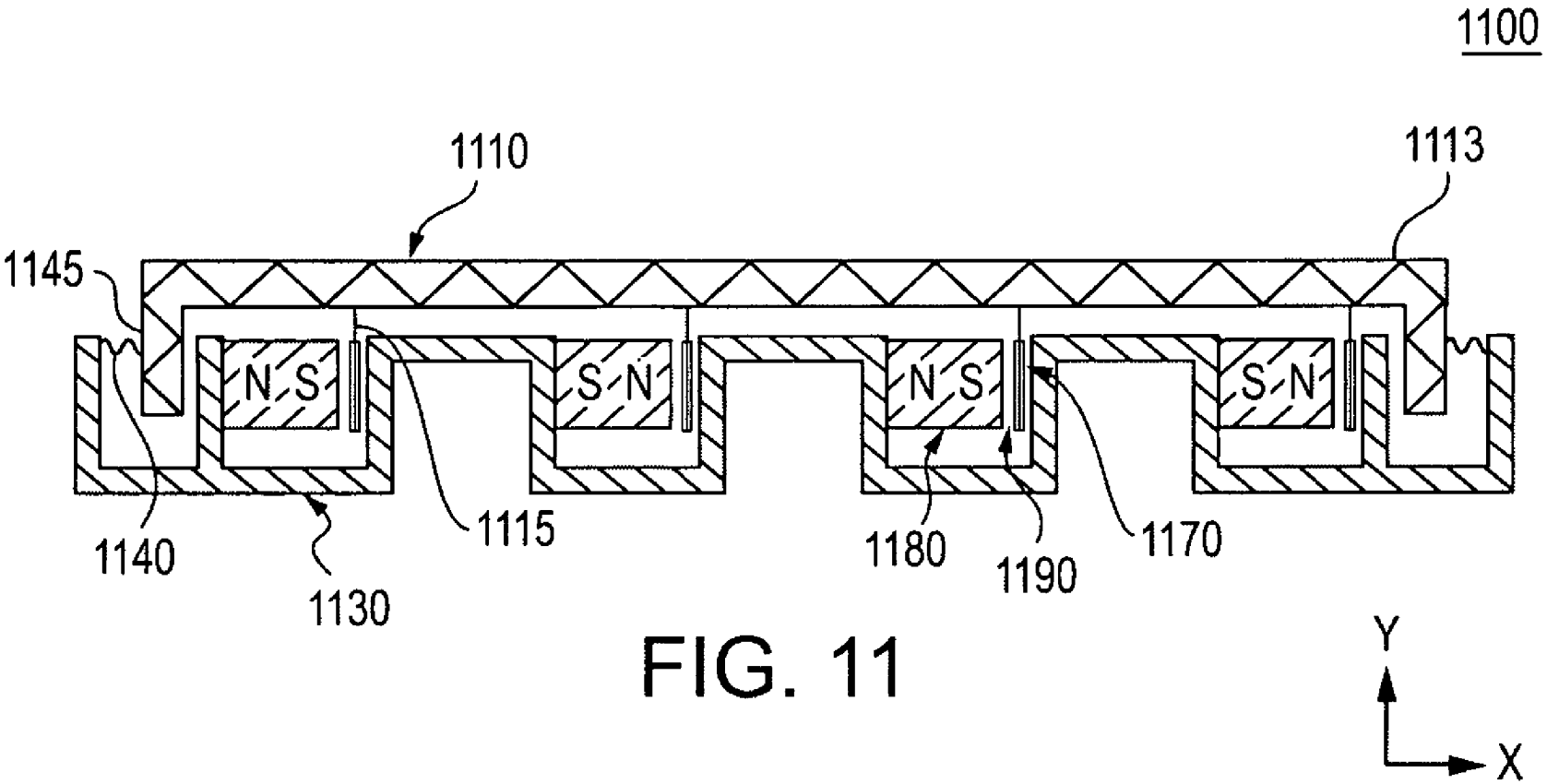
FIG. 11 depicts a cross section of a fifth embodiment of a low-profile transducer.

FIG. 11 is a cross-sectional view of a fifth embodiment of a low-profile transducer 1100. The low-profile transducer 1100 includes a crenellated ferromagnetic frame 1130, a rigid diaphragm 1110 having a substantially planar projection surface 1113, stationary magnets 1180, magnetic gaps 1190; voice coils 1170; and a pliable surround 1140. The diaphragm 1130 of the low-profile transducer 1100 also includes side portions 1145 that extend away from the planar surface 1113 of the diaphragm. The side portions 1145 may extend perpendicularly away from the planar surface 1113 in the same directions as the voice coils 1170.

The diaphragm 1110 is made of a substantially rigid material, with voice coils 1170 mounted onto the diaphragm and extending away from the diaphragm. The voice coils 1170 are preferably mounted in a direction extending perpendicularly away from the surface of the diaphragm 1110, and reside partially in the magnetic gaps 1190 formed by the magnets 1180 and the frame 1130. The stationary magnets 1180 are attached to a portion of the frame 1130 extending in the z-direction, with poles aligned in the x-direction.

As shown in FIG. 11, diaphragm 1110 may be operatively attached to the frame 1130 by the pliable surround 1140, with the pliable surround 1140 connecting to the side portions 1145 of the diaphragm at points that are substantially outside the plane of the planar surface 1113. The pliable surround 1140 may be connected to the side portions 1145 of the diaphragm at points that are closer to the center of mass of the diaphragm 1110 (with the attached voice coils 1190) than is the planar surface 1113. A designer may select points of attachment for the pliable surround 1140 onto the diaphragm 1110 to avoid excitation of rocking modes of the diaphragm, or to otherwise enhance mechanical operation of the transducer. In a preferred implementation, the pliable surround 1140 may be connected to the diaphragm at points that are coplanar with the center of mass of the diaphragm 1110 and the attached voice coils 1190. In other implementations, the pliable surround 1140 may be connected to the diaphragm at any point on the side portions 1145, including points that are not coplanar with the planar surface 1113.

The side portions 1145 of the diaphragm may be formed with ribs, or ribs may be added to the side portions 1145, to reinforce the mechanical stability of the side portions 1145. Alternatively, or in addition, reinforcing structures such as gussets or ribs may be added to the side portions 1145 for enhancing the mechanical rigidity of the side portions.

Yet another approach to enhancing the mechanical rigidity of the side portions includes adding a skirt structure that extends away from the plane of the side portions. The skirt structure may be used to add rigidity to the side structures in the same way that flanges in an I-beam add rigidity to a central portion of the beam. The skirt structure may alternatively be formed by introducing an appropriate bend into the side portions of the diaphragm, as discussed below.

Figure 12:
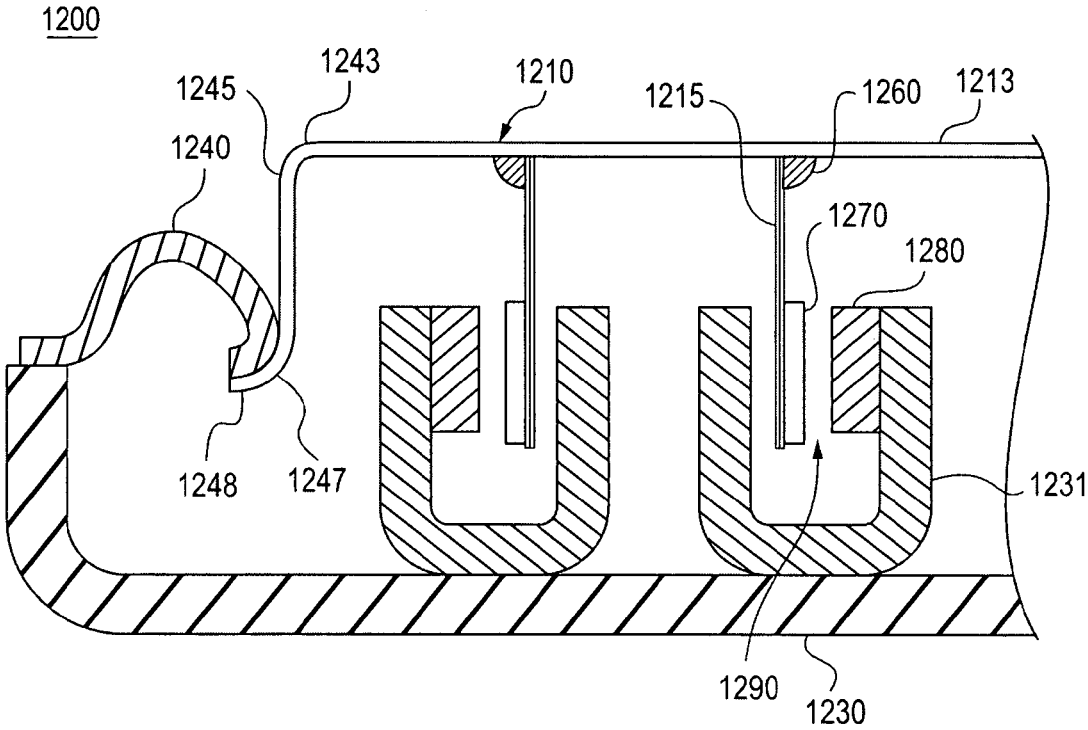
FIG. 12 depicts a cross section of a sixth embodiment of a low-profile transducer.

FIG. 12 is a cross-sectional view of a sixth embodiment of a low-profile transducer 1200. The low-profile transducer 1200 includes a non-ferromagnetic frame 1230, a diaphragm 1210 having a substantially planar projection surface 1213, U-shaped ferromagnetic yokes 1231, stationary magnets 1280, magnetic gaps 1290; fins 1215, voice coils 1270; and a pliable surround 1240. The diaphragm 1230 of the low-profile transducer 1200 also includes at least one bend 1243 that forms a side portion 1245 that extends away from the planar surface 1213 of the diaphragm. The side portion in turn has a bend 1247 that forms a skirt portion 1248 that extends away from the side portion 1245.

The diaphragm 1210 may be made of a substantially rigid material, with fins 1215 mounted onto the diaphragm. The fins 1215 may be mounted onto the projection surface 1213 at an angle so that the fins extend away from the projection surface 1213. The fins 1215 may be bonded to the projection surface 1213 with glue 1260.

The ferromagnetic yokes 1231 are mounted with the bases of their U-shaped structures attached to the frame 1230. The stationary magnets 1280 are each mounted on one of the U-shaped ferromagnetic yokes 1231 at locations on the inside of the U-shaped structure, close to an end of one arm of the U-shape. This structure provides the magnetic gap 1290 between the stationary magnet 1280 and an opposing section of the other arm of the ferromagnetic yoke 1231. The voice coils 1270 are preferably mounted onto the fins 1215, and reside partially in the magnetic gaps 1290 formed by the magnets 1280 and the ferromagnetic yokes 1231.

The side portion 1245 of the diaphragm may extend at an angle away from edges of the planar surface 1213 in the same direction as the fins 1215. Similarly, the skirt portion 1245 may extend at an angle away from the side portion 1245. These angles for bends 1243 and 1247 may be perpendicular, but other angles may also be used. For example, in some implementations of the transducer 1200, an angle of between 35° and 135° may be formed between the skirt portion 1248. The bend 1247 may be appropriately formed to impart added rigidity to the side surface 1245, thereby inhibiting flexing of the side surface 1245.

As shown in FIG. 12, the pliable surround 1240 connects the frame 1230 to the side portion 1245 of the diaphragm 1210. The pliable surround 1240 may be attached to the side portion 1245 at points that define a plane parallel to the projection surface 1213, but not coplanar with the projection surface 1213. A designer may select points of attachment for the pliable surround 1240 onto the diaphragm 1210 to avoid excitation of rocking modes of the diaphragm, or to otherwise enhance mechanical operation of the transducer. For example, points of attachment for the pliable surround 1240 onto the side portion 1245 may be coplanar with a center of mass of the diaphragm 1210 and the attached fins 1215 and voice coils 1270. In general, the points of attachment for the pliable surround 1240 onto the diaphragm 1210 may be at any location along the side portion 1245.

Voice coils may be fabricated using a variety of techniques and materials. A voice coil may be formed of a conductor attached at least at two positions, hence forming a coil, to an electric potential. The electric potential is generally provided by a power amplifier capable of providing electric current to the voice coil, where the electric current is representative of an audio signal. Suitable voice coils typically have a frequency response between 20 and 20,000 Hz, and may be designed so that a loudspeaker has a well-defined impedance, such as 4 ohms, 8 ohms, or other values, with a tolerance for a specific amount of delivered power. The voice coil may provide a single path for electric current or have multiple, electrically independent portions providing multiple electric-current paths.

Voice coils may have a substantially elongated shape and may run substantially parallel with the stationary magnets. The alignment of the voice coil with its associated stationary magnet may be selected to enable efficient interaction between the magnetic field produced by the stationary magnet and the magnetic field produced by its associated voice coil. Thus, when the voice coil is energized, the alternating repulsive and attractive magnetic forces generated between the stationary magnet and the voice coil cause the attached diaphragm to vibrate and efficiently reproduce a sound wave. In certain applications, the voice coils may be mounted so that a majority of the conductive traces are substantially outside the plane of the acoustic surface of a diaphragm in a planar transducer. For example, the voice coils may me mounted on fins extending from the diaphragm, or may be mounted on side surfaces, or the voice coils may be directly bonded onto the diaphragm, with a majority of the conductive portion of the voice coils extending away from the diaphragm.

Voice coils may be made from electrically conductive wires, traces, sheets, or foils, for example. The voice coil can include any electrically conductive material, such as wires or substantially flat sheets of conductive metals such as silver, gold, copper, aluminum, and combinations thereof. These metals may be used as mixtures, as alloys, or in combination. Conductive inks may also be utilized.

The frame of a planar transducer may be fabricated using a variety of techniques and materials. In general the frame of a low-profile transducer may be any ferromagnetic material, such as iron or steel, that can support the diaphragm and stationary magnets, and provide a return path for field lines. The frame may alternatively be constructed of a non-ferromagnetic material, such as polymer resins and glass or carbon fibers, preferably with the addition of ferromagnetic yokes around the magnets to provide return paths for channeling the magnetic fields. The frame may also include a combination of metals and polymers.

In addition to supporting the diaphragm and the stationary magnets, the resonance frequency of the frame may be altered with non-resonant materials, including, but not limited to polymers, so distortion may be reduced during operation. A sandwich of synthetic material, such as nylon or DACRON or other polyester fiber-materials, and fiberglass may be bonded to the frame to acoustically damp the transducer. Optional cross-braces may also exist between various portions of the frame to further reinforce its structure. One or more surfaces of the frame that are opposite the diaphragm may also be perforated at one or more locations to allow air to exit the rear of the low-profile transducer. The diaphragm may be bonded to a pliable surround with an adhesive, such as cyanoacrylate.

The diaphragm may also be constructed through a variety of techniques. Depending on the application, a diaphragm may be flexible or rigid. For example, the diaphragm may be molded or formed of metals, plastics, thermoplastics, resins, or composite materials. A diaphragm may also be made by gluing or otherwise joining components that are individually molded or formed. Thin-film forming materials may also be used for diaphragms, such as diaphragm 1010. A diaphragm also may formed by appropriately folding a flat material, such as a sheet with fins interconnected at the ends as shown in FIGS. 4 and 5. The diaphragm may be two sheets of material with a bonded inner structure.

Diaphragms may be made from any suitable non-electrically conductive material. These materials include, but are not limited to, natural or synthetic polymers, cellulose, doped or impregnated cellulose, polyvinylchlorides (PVC), polyethylenenaphthalates (PEN), polyesters (e.g., MYLAR), polyvinylfluorides (PVF), polyimides, synthetic fibers or composites such as KEVLAR, and doped or impregnated fabrics, such as lacquered silk. Diaphragms may also be made of conductive materials, with added insulation isolating the diaphragms from the voice coils.

The diaphragm may be attached to the frame with a pliable surround, such as support 240 or support 940. The pliable surround allows the diaphragm to move relatively freely when energized. Conventional planar designs have highly tensioned diaphragms, similar to the head of a drum. The diaphragms described herein may similarly be tensioned structures. Alternatively, the pliable surround utilized in a low-profile transducer may be configured not to apply significant lateral tension to the face of diaphragm. In fact, the pliable surround may be used to prevent the diaphragm from being put under tension, which would occur from a relatively noncompliant attachment as utilized in a conventional planar transducer. In this aspect, the diaphragm of the low-profile transducer may move relatively freely, as does the cone of a cone-type transducer.

It follows that the degree of movement a conventional planar transducer diaphragm undergoes when energized is dependent on the compliance of the material from which the diaphragm is made. The degree of movement that the diaphragm of the low-profile transducer undergoes when energized may be similarly dependent on the compliance of material from which it is made, but may also be dependent on the design of the pliable surround.

While the pliable surround can allow the diaphragm to move relatively freely when the voice coil is energized, the pliable surround may also provide a damping effect to the diaphragm. Thus, by tuning the compliance of the pliable surround, the damping applied to the diaphragm, and hence the frequency response of the transducer may be altered.

The pliable surround may include one or more materials and may be in one or more pieces. For example, pliable surround 240 may be attached between the projection surface of the diaphragm and the frame. Alternatively, or in addition, pliable surround 1040 may also be between a perimeter edge of the diaphragm and the frame. Pliable surround support 940 may connect the diaphragm to the side 935 of the frame. Any of these and other arrangements may support the diaphragm and reduce the transfer of vibrations from the diaphragm to the frame.

The flexibility in choosing an attachment point of the pliable surround may also provide designers a tool for minimizing undesired rotation of the diaphragm. The pliable surround may be attached at points on the side surface of the diaphragm that surround the center of mass of the diaphragm. Such a configuration, would minimize the amount of torque applied to the diaphragm, thereby reducing undesired wobbling motions in the diaphragm.

The pliable surround may extend fully or only partially around the diaphragm and may be one or more pieces. The pliable surround may be attached to the frame and/or diaphragm with one or more adhesives, mechanical fasteners, such as brads, interlocking edges, or by heat shrinking, for example. The pliable surround may have a channel that is placed around the edge of the frame and heat-shrunk into place. The diaphragm may then be attached to the pliable surround by adhesive. The diaphragm may be rigidly bonded to the pliable surround, which is rigidly bonded to the frame.

A variety of materials may be used in the pliable surround. Among the design criteria for selecting materials are the ability to support the diaphragm and reduce vibration transfer. Examples of materials include porous or fibrous materials such as foam, foam rubber, natural or synthetic rubber, natural or synthetic polymers, cloth, impregnated cloth, and felt. The material may also be folded or hinged to further alter its compliance, as described in U.S. Pat. No. 4,056,697, which is incorporated herein by reference in its entirety.

The stationary magnets may be mounted in a variety of configurations in a planar transducer. The stationary magnets may be electromagnets or permanent magnets. Any magnetic material may be used, including relatively strong magnets with a high energy product. Stationary magnets having a high energy density, such as neodymium, also may be used. As would be appreciated by a skilled artisan, a variety of magnets may be used, with strengths appropriate for particular implementations and geometries. The magnets may be formed of a variety of materials, such as materials containing ferrite, strontium ferrite, samarium cobalt, Alnico (Al, Ni, and Co), or neodymium. Examples of suitable alloys include alinco, iron-chrome-cobalt, samarium cobalt, neodymium-iron-boron, neodymium-cobalt-boron, iron-chrome-cobalt, and others. The stationary magnets may be a single magnet or made from a series of individual magnets arranged in a row. In one implementation, the poles of the magnets may be aligned along a direction parallel to the projection surface of a planar transducer. The utilization of multiple magnets may be advantageous, especially as the length of the frame increases to support larger diaphragms having a lower frequency response.

The voice coil of a low-profile transducer resides in region of magnetic field produced by a stationary magnet. This magnetic-field region may be a magnetic gap, between opposing magnetic poles. The opposing magnetic poles may be the poles of magnets, or may be poles of ferromagnetic material, such as a section of a ferromagnetic frame. Magnetic poles may be formed with other geometries, as well, such as through the use of pole pieces or back plates in a T-yoke or other magnetic circuits for example. Alternatively, the magnetic-field region may be a region of magnetic field close to one magnetic pole.

The voice coil is preferably positioned so that it is in a region of strong magnetic field, with the field preferably having little variation in direction or intensity over the space in which the voice coil moves. The distance between the magnetic pole and the voice coil does not appreciably change during operation because the voice coil moves in a direction (e.g., in a y-direction) that is parallel to the edge of material that forms magnetic pole. The region of magnetic field can take a variety of forms, including a channel or groove.

The voice coil of a low-profile transducer may be attached to the portion of the diaphragm which resides at least partially in the region of magnetic field by a variety of methods, including techniques known to those of ordinary skill in the art. The conductor may be printed, plated, adhesive bonded, laminated, or vapor deposited on the diaphragm. Additionally, the conductive material may be attached to a relatively large portion of the diaphragm and then removed through etching or a similar process from those areas where the conductive material is not desired.

One approach for bonding a voice coil to a diaphragm involves attaching the voice coil to the diaphragm material before the diaphragm material is folded into a final shape, such as discussed above for the folding pattern described in FIG. 4. Various approaches may be used for bonding the voice coil to the diaphragm. For example, etch resist, photoresist, or other techniques used for creating conductor traces on printed circuit boards may be used or adapted for creating voice coils on a diaphragm material. Alternatively or in addition, the manufacture of the diaphragm may include sandwiching the voice coil inside layers of diaphragm material. The conductor may be placed on a sheet of diaphragm material and a second sheet of diaphragm material is then bonded with adhesive or heat to the first sheet, thus trapping the conductor. Tinsel leads may be used for connecting ends of a planar voice coil to audio circuitry that provides an electrical signal to the voice coil.

A variety of applications are envisioned for low-profile transducers. Depending on its particular configuration, a low-profile transducer can be used alone by mounting the frame to a surface, such as the wall of a room, a wire suspended from a ceiling, a floor stand, or an interior panel of an automobile. The transducer also may be mounted in or onto a loudspeaker enclosure.

A loudspeaker may include one or more transducers that work together to convert an electric signal into acoustical energy. Generally, a loudspeaker has multiple transducers in a single cabinet. However, multiple cabinets may also be used. A high frequency transducer may reside in a relatively small cabinet while a low frequency transducer resides in a relatively larger cabinet positioned beneath the smaller cabinet. The transducer may be mounted in a loudspeaker enclosure that also includes a cone-type transducer optimized to reproduce low frequencies, so that the cone-type transducer reproduces the lower octaves of the signal while the transducer reproduces the upper octaves.

While not necessary, a crossover is usually included as a component of a loudspeaker. A crossover may be an active or passive electronic device that limits or separates an output frequency in relation to a wider input frequency. For example, a loudspeaker may be designed to receive signals with frequencies in the range of 20 Hz to 20 kHz. A crossover in the loudspeaker may be used to output only the 20 to 100 Hz frequencies to a cone-type transducer in the loudspeaker, while outputting the 100 to 20,000 Hz frequencies to a planar transducer in the loudspeaker.

The low-profile transducer may be configured to adapt the benefits of a strong magnetic field to a relatively planar format. The planar format gives a designer additional flexibility to use many mounting options, as appropriate, including mounting against walls and in vehicle interiors. Because the voice coils may reside in a strong magnetic field, the transducer may be able to efficiently produce high SPL levels from a given current input with good linearity and low distortion over a broad frequency range, with additional benefits due to the homogeneity of the magnetic field. A low-profile transducer may provide a designer with flexibility to use multiple voice coils where needed to apply a relatively uniform force to the diaphragm and to handle high current inputs, or to provide enhanced excursion and power handling.

While various embodiments of the invention have been described, it will be apparent to those of ordinary skill in the art that other embodiments and implementations are possible that are within the scope of the invention. Accordingly, the invention is not to be restricted except in light of the attached claims and their equivalents.

What is claimed is:

1. A low-profile transducer comprising:

a frame comprising a ferromagnetic material and providing a closed return path for a magnet field generated by a magnet structure;

a diaphragm having a substantially planar projection surface, where the diaphragm is operatively attached to the frame;

the magnet structure mounted on the frame, where the magnet structure produces a magnetic-field region; and an electrically conductive voice coil coupled to the diaphragm and extending out of a plane of the projection surface;

where the voice coil resides at least partially in the magnetic-field region; and where the magnet structure includes a pole surface, and where a distance between the pole surface and the voice coil is substantially constant during excursions of the voice coil.

2. The low-profile transducer of claim 1, where the magnetic-field region is substantially uniform throughout an excursion region of the voice coil.

3. The low-profile transducer of claim 1, where the voice coil has a substantially flat structure in the magnetic-field region, and where a plane of the voice coil in the magnetic-field region is substantially perpendicular to a magnetic field in the magnetic-field region.

4. The low-profile transducer of claim 1, further comprising:

a fin having a first edge and an opposing second edge;

where the first edge of the fin is attached to the projection surface;

where the fin extends in a direction away from the projection surface and into the magnetic-field region; and where the voice coil is mounted on the fin.

5. The low-profile transducer of claim 4, where the fin extends in a direction substantially perpendicular to the projection surface.

6. The low-profile transducer of claim 1, where the magnet structure comprises a magnet and a portion of the frame.

7. The low-profile transducer of claim 1, where the magnet structure comprises a magnet and a portion of the frame, and where the magnetic-field region is formed between the magnet and the portion of the frame.

8. The low-profile transducer of claim 1, where the magnet structure comprises a magnet and a ferromagnetic material.

9. The low-profile transducer of claim 1, where the frame has a substantially crenellated shape.

10. The low-profile transducer of claim 1, where the frame includes a groove.

11. The low-profile transducer of claim 1, where the projection surface of the diaphragm is in the shape of a rectangle.

12. The low-profile transducer of claim 1, comprising at least three voice coils and further comprising three fins, where one of the voice coils is mounted on each of the fins.

13. The low-profile transducer of claim 1, further comprising side surfaces at two or more perimeter edges of the projection surface, where the side surfaces extend out of a plane of the projection surface.

14. The low-profile transducer of claim 13, where the voice coil is mounted on a side surface.

15. The low-profile transducer of claim 13, further comprising at least one fin mounted between the two perimeter edges of the projection surface.

16. The low-profile transducer of claim 15, where the projection surface and the fin are formed from a single sheet of material.

17. The low-profile transducer of claim 16, where a 90° fold in the sheet of material is adjacent to a 180° fold in the sheet of material.

18. The low-profile transducer of claim 16, where two 90° folds in the sheet of material are adjacent to a 180° fold in the sheet of material.

19. The low-profile transducer of claim 16, where a first 90° fold in the sheet of material is adjacent to a second 90° fold and the second 90° fold is adjacent to a 180° fold in the sheet of material.

20. The low-profile transducer of claim 1, further comprising a filler material attached to the projection surface, and a second sheet of material attached to the filler material, where the filler material and the second sheet provide additional rigidity to the projection surface.

21. The low-profile transducer of claim 1, further comprising a second sheet of material attached to the projection surface.

22. The low-profile transducer of claim 1, where the projection surface of the diaphragm is operatively attached to the frame.

23. The low-profile transducer of claim 22, where the attachment is provided by a pliable surround.

24. The low-profile transducer of claim 1, further comprising a side surface connected at an angle to the projection surface, where the side surface is operatively attached to the frame.

25. The low-profile transducer of claim 24, where the attachment is provided by a pliable surround.

26. The low-profile transducer of claim 1, where the magnet structure comprises at least two stationary magnets having two magnetic-field regions.

27. The low-profile transducer of claim 1, where the magnet structure comprises a permanent magnet and a ferromagnetic yoke structure.

28. The low-profile transducer of claim 1, where the magnet structure comprises a permanent magnet.

29. The low-profile transducer of claim 1, where the magnet structure comprises an electromagnet.

30. The low-profile transducer of claim 1, where the magnet structure comprises a material selected from the group consisting of ferrite, neodymium, strontium, samarium cobalt, mixtures of Al, Ni, and Co, and combinations thereof.

31. The low-profile transducer of claim 1, where the frame has a substantially crenellated shape, and where the magnet structure includes a magnet attached to a portion of the crenellated frame.

32. The low-profile transducer of claim 31, where the magnet is attached to the frame and oriented so that adjacent to a pole of the magnet, a magnetic field of the magnet is oriented substantially parallel to the projection surface.

33. The low-profile transducer of claim 31, where the magnet is in contact with the bottom of the frame.

34. The low-profile transducer of claim 31, where the frame comprises a groove, and where the magnet is adjacent to the groove.

35. The low-profile transducer of claim 1, where the voice coil comprises a metal selected from the group consisting of silver, gold, aluminum, copper, and mixtures thereof.

36. The low-profile transducer of claim 1, where the voice coil comprises a substantially flat ribbon of metal.

37. The low-profile transducer of claim 1, where a conductive metal is formed on a fin of the diaphragm to form the voice coil.

38. The low-profile transducer of claim 1, where the voice coil comprises an insulated metal wire.

39. A method of reproducing a sound wave comprising:

supplying an electric potential of changing polarity to a voice coil residing in a magnetic-field region, where the voice coil is operatively attached to a non-electrically conductive diaphragm having a substantially planar projection surface and at least one fin, where a magnet structure includes a pole surface, and where a distance between the pole surface and the voice coil is substantially constant during excursions of the voice coil, and where the fin is substantially perpendicular to the projection surface.

40. The method of claim 39, where the diaphragm is attached to a frame by a pliable surround.

41. A low-profile transducer comprising:

a frame providing a closed return path for a magnetic field generated by a magnet structure;

a diaphragm having a substantially planar projection surface, where the diaphragm is operatively attached to the frame;

the magnet structure mounted on the frame, where the magnet structure produces a magnetic-field region;

an electrically conductive voice coil residing at least partially in the magnetic-field region and coupled to the diaphragm and extending out of a plane of the projection surface;

side surfaces at two or more perimeter edges of the projection surface, where the side surfaces extend out of the plane of the projection surface; and at least one fin mounted between the two perimeter edges of the projection surface and, with the projection surface, formed from a single sheet of material, where a 90° fold in the sheet of material is adjacent to a 180° fold in the sheet of material.

42. A low-profile transducer comprising:

a frame comprising a ferromagnetic material and providing a closed return path for a magnetic field generated by a magnet structure;

a diaphragm having a substantially planar projection surface, where the diaphragm is operatively attached to the frame;

the magnet structure mounted on the frame and comprising a magnet and a portion of the frame, where the magnet structure produces a magnetic-field region; and an electrically conductive voice coil coupled to the diaphragm and extending out of a plane of the projection surface and residing at least partially in the magnetic-field region, wherein the magnetic-field region is formed between the magnet and the portion of the frame.

* * * * *